US005947003A

United States Patent [19]

Jepsen et al.

[11] Patent Number: 5,947,003

[45] Date of Patent: Sep. 7, 1999

[54] HYDRAULIC PISTON MACHINE WITH FRICTION-REDUCING LAYER ON THE CYLINDER AND THE CYLINDER BEARING

[75] Inventors: Hardy Peter Jepsen, Nordborg; Zoltan Gürtler, Augustenborg, both of Denmark

[73] Assignee: Danfoss A/S, Nordborg, Denmark

[21] Appl. No.: 08/765,412

[22] PCT Filed: Jun. 28, 1995

[86] PCT No.: PCT/DK95/00272

§ 371 Date: Dec. 26, 1996

§ 102(e) Date: Dec. 26, 1996

[87] PCT Pub. No.: WO96/02752

PCT Pub. Date: Feb. 1, 1996

[30] Foreign Application Priority Data

Jul. 13, 1994 [DE] Germany ..... 44 24 670

[51] Int. Cl.[6] ..... F04B 1/20

[52] U.S. Cl. ..... 92/248; 92/71; 417/269

[58] Field of Search ..... 92/71, 170.1, 248

[56] References Cited

U.S. PATENT DOCUMENTS 3,125,004 3/1964 White .

5,520,088 5/1996 Dixen ..... 92/71

5,813,315 9/1998 Kristensen et al. ..... 92/71

OTHER PUBLICATIONS

Handbook of Chemistry and Physics, CRC Press, 60th Edition, Dec. 1979.

*Primary Examiner*—Timothy S. Thorpe
*Assistant Examiner*—Ehud Gartenberg
*Attorney, Agent, or Firm*—Lee, Mann, Smith, McWilliams, Sweeney & Ohlson

[57] ABSTRACT

A hydraulic piston machine is disclosed, having a piston arranged to move back and forth in a cylinder body. In such a machine it is desirable to be able to achieve a longer service life, even when the hydraulic medium is not suitable for lubricating the bearing faces. For that purpose, at least on its outer face sliding on the cylinder body, the piston has a layer of a friction-reducing plastics material, wherein at the end of the piston there is provided a bearing face of an articulated joint by means of which a slide shoe is connected, articulated to the piston, the layer being continued onto the bearing face.

9 Claims, 1 Drawing Sheet

HYDRAULIC PISTON MACHINE WITH FRICTION-REDUCING LAYER ON THE CYLINDER AND THE CYLINDER BEARING

BACKGROUND OF THE INVENTION

The invention relates to a hydraulic piston machine having a piston arranged to move back and forth in a cylinder body.

In such a case, several cylinders containing the pistons are normally arranged in the cylinder body. Hydraulic machines which convert pressure and movement into one another by means of pistons moving back and forth in cylinders have been known for a long time. Such machines work as motors when the pressure of the hydraulic fluid is to be converted into movement. They work as pumps when a movement is to be converted into an increase in pressure of the hydraulic fluid. In machines of that kind the sliding contact surfaces in the cylinders in which the pistons move back and forth suffer extreme stress caused by high sliding speeds and huge bearing pressures. In order to keep wear and tear in such machines as low as possible, it is customary not to let the pistons run directly in the bores which form the cylinders in the cylinder body, but to insert cylinders or bushings in the cylinder body in which the pistons are able to move. In this manner it is indeed possible in many cases to use suitable material pairings between piston and cylinder bushing without having to make the entire cylinder body of the generally more expensive and less stable material of the bushing. It is relatively difficult, however, to secure such bushings in the cylinder body with the required reliability. An adhesive join is in many cases not capable of accommodating the relatively large shear forces between bushing and cylinder body. For that reason, (DE-AS 12 67 985) proposes securing the cylinder bushing by means of a press fit in the cylinder bore in the cylinder body, and causing an enlargement initially projecting inwardly into the cylinder bushing to be reshaped outwardly by means of a mandrel into a corresponding annular groove in the cylinder bore. It is a prerequisite here that the material of the cylinder bushing allows such a reshaping, without the cylinder bushing being damaged. This is normally the case only with metals.

In conjunction with the use of hydraulic fluids which have only slight or even no lubricating properties, it is now wished to provide the material pairing at the sliding contact surface at least on one side with a plastics material. Such plastics materials can be shaped in the manner described only with difficulty. Fixing in a cylinder body is possible, but complicated (see the two prior German patent applications P 43 01 124 and P 43 01 126).

From DE-Z "Der Zuliefermarkt" (The Supply Market), April 1986, A. Knittel, Rotary Metering Pistons of Plastics Material, is it known to manufacture a piston of plastics material, for example, in the form of an injection-moulded part. Such a plastics material piston is unsuitable, however, for use in a hydraulic machine. Most plastics materials are quite unable to withstand the pressures occurring in the cylinder of a hydraulic machine. The pressures lead to deformation of the piston so that this jams in the cylinder bore.

SUMMARY OF THE INVENTION

The invention is based on the problem of being able to operate a hydraulic piston machine even with hydraulic fluids that have no or only slight lubricating properties, such as, for example, with water.

In a piston machine of the kind mentioned in the introduction this problem is solved in that, at least on its outer face sliding on the cylinder body, the piston has a layer of a friction-reducing plastics material, wherein at the end of the piston there is provided a bearing face of an articulated joint by means of which a slide shoe is connected, articulated, to the piston, the layer being continued over the bearing face.

The "friction-reducing" property is always with respect, of course, to the material of the cylinder body against which this plastics material rubs. Suitable plastics material for the layer are in particular materials from the group of high-strength thermoplastic plastics materials based on polyarylether ketones, in particular polyether ether ketones, polyamides, polyacetals, polyaryl ethers, polyethylene terephthalates, polyphenylene sulphides, polysulphones, polyether sulphones, polyether imides, polyamideimide, polyacrylates, phenol resins, such as novolak resins, or similar substances; glass, graphite, polytetrafluoroethylene or carbon, especially in fibre form, can be used as fillers. The improvement in friction is here shifted from the cylinder body or the cylinder wall to the piston. Because the piston is; provided only with a friction-reducing layer of a plastics material, but does not consist entirely of the plastics material, it is possible still to construct it with the necessary strength. Even at higher pressures no deformation of the piston, which could lead to the piston's becoming jammed in the cylinder, will occur. Using this relatively simple measure, a hydraulic machine can now be operated even with fluids that have no lubricating properties, for example, with water. Nonetheless, the machine may have a relatively long service life and a satisfactory operational behaviour. In the case of axial piston machines, the slide shoe lies, for example, against a swash plate. When the cylinder body, which is then in the form of a cylinder drum, performs a rotation through 360°, the slide shoe pivots through a predetermined angle with respect to the piston depending on the angular position of the swash plate. Here too, friction is created, in fact in the articulated connection. If one of the bearing faces is now provided with the friction-reducing layer, wear and tear on this bearing face can be kept small, even if the hydraulic fluid has no lubricating properties. Because the friction-reducing layer is continued onto the bearing face, there are also relatively few opportunities for the hydraulic fluid to penetrate into the region between the piston and the layer. Since the bearing face is normally of a shape other than that of a cylinder, continuing the layer onto the bearing face produces an interlocking engagement between piston and layer. The retaining force is accordingly improved. The layer takes up less room than a bushing in the housing. With otherwise the same dimensions the cylinder can therefore be made larger, thus enabling the pressure to be made smaller or more cylinders to be used.

The layer extends preferably over at least a part of the end face of the piston which projects into the cylinder body. This construction firstly ensures that the end of the piston that projects into the cylinder body is completely provided with the friction-reducing layer as far as its end. Secondly, the end face of the piston acquires a kind of damping pad. The plastics material is normally somewhat softer than the metal core of the piston.

The piston preferably has a through-channel and the layer also lines the through-channel. Normally, hydraulic fluid is conveyed through the through-channel to the slide shoe to effect hydrostatic lubrication at the sliding contact surface thereof which, in an axial piston machine, is in contact with the swash plate. If the plastics material now lines also the through-channel, the piston can be completely sealed with the plastics material. No gaps or seams are left through which hydraulic fluid could penetrate between the piston and the plastics material, which in adverse circumstances could lead to the plastics material becoming detached from the piston and to subsequent damage. If the plastics material is applied in an injection-moulding process, the piston must, of course be held somehow or other in the injection mould. The supporting means are then arranged in a region which ought normally to be free from pressure, so that here too no hydraulic fluid is forced between piston and plastics material.

In another preferred construction, provision is made for the layer to cover only a part of the surface of the piston. In that case there is a saving on plastics material, which can have advantages as regards costs.

It is also preferred for the layer to terminate within a space loaded with fluid pressure, so that the area loaded with pressure is always larger than the area of the edge of the layer. The pressure in the space is the same all round. The resulting forces on the plastics material layer are, however, in all operating states larger in a direction which presses the layer onto the piston than in the direction which runs parallel to the surface of the piston core. Even when the end face of the layer, that is, as it were, the end, is loaded with fluid pressure, the holding forces are greater, so that here too fluid is reliably prevented from penetrating.

The articulated connection preferably comprises a spherical head and a spherical socket, the spherical socket has an opening of which the diameter is at least as large as the diameter of the spherical head and encloses the spherical head in cross-section by more than 180°, and the layer has a thickness that increases the diameter of the spherical head so that it is larger than the diameter of the opening of the spherical socket. With this construction, assembly of piston and slide shoe can be quite dramatically simplified. The piston and the slide shoe are simply fitted together, which presents no problems on account of the said dimensions. The plastics material is then taken into the gap between the piston and the slide shoe, or more accurately, into the space between the spherical head and the spherical socket, whereby the spherical head is fixed as desired in the spherical socket.

The invention also relates to a method for mounting a piston/slide shoe unit of a hydraulic piston machine in which the piston and the slide shoe are assembled. Here, the piston is provided with a layer of friction-reducing plastics material and the plastics material is inserted into the articulated connection between piston and slide shoe. In this manner, as described above, a quick, easy and reliable mounting of the machine is achieved, whilst ensuring that the operational behaviour, in particular the service life, is satisfactory. It is much simpler to provide the piston with the layer of friction-reducing plastics material than to insert a bushing into the cylinder body or even line the cylinder bore with a plastics material by injection moulding.

The plastics material is preferably injection-moulded. By means of an injection-moulding method high accuracy rates can be achieved in manufacture.

It is also preferred for all the plastics; material to be applied in one operation. The totality of the plastics material therefore includes the friction-reducing layer that is arranged between the piston core and cylinder bore and the friction-reducing layer that is arranged in the joint between the piston and the slide shoe.

BRIEF DESCRIPTION OF THE DRAWINGS

The invention is explained hereinafter with reference to a preferred embodiment in conjunction with the drawings, in which.

DESCRIPTION OF THE PREFERRED EMBODIMENTS

Figure 1:
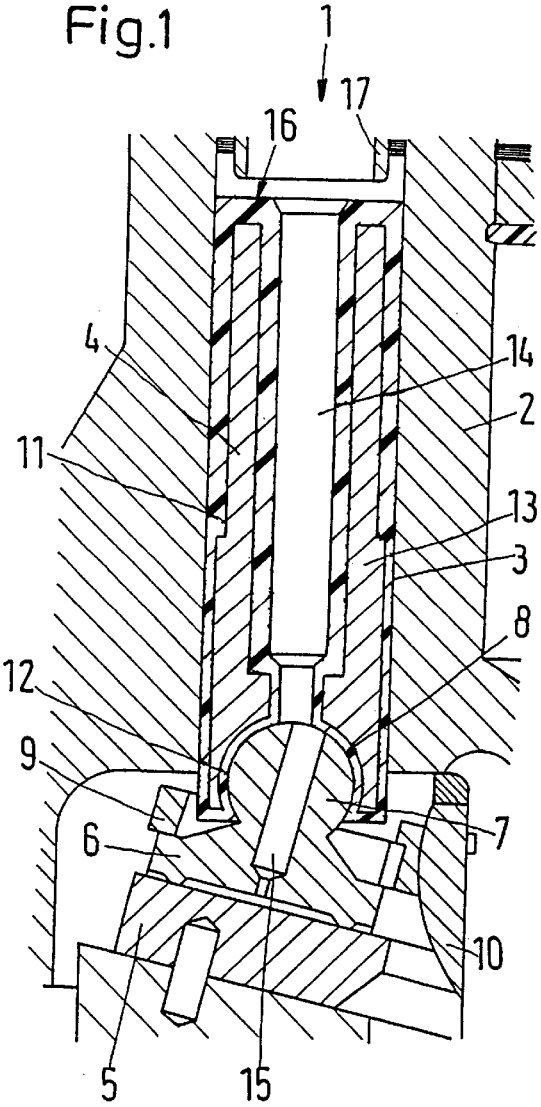
FIG. 1 shows in section part of a first construction of a hydraulic piston machine.

A piston machine 1 has a cylinder drum 2 in which several cylinders 3, one of which is illustrated, are arranged. In each cylinder a piston 4 moves back and forth. In the orientation illustrated this is an up and down movement.

This back and forth movement of the piston 4 is controlled by a swash plate 5 against which a slide shoe 6 lies; the slide shoe is connected to the piston 4 by way of a ball-and-socket joint. The ball-and-socket joint consists of a spherical head 7, which in the present embodiment is secured to the sliding shoe 6, and a spherical socket 8, which in the present embodiment is arranged at the end of the piston 4 projecting from the cylinder 3.

As usual the slide shoe is held in contact with the swash plate 5 by a pressure plate 9. For that purpose, the pressure plate 9 is pressed by a spherical member 10 towards the swash plate 5.

To reduce the friction between the piston 4 and the cylinder 3, the piston is provided with a layer 11 of a friction-reducing plastics material, at least in the region between the piston 4 and the cylinder 3 where these two parts rub against one another. In the embodiment illustrated, however this layer 11 is also continued to a region 12 at which the spherical head 7 and spherical socket 8 rub against one another. The piston 4, which has a core 13 consisting of a strong metal, is furthermore provided with a through-bore 14, which extends right through the entire piston 4. Hydraulic fluid is able to pass through this through-bore to the region 12 between the slide shoe 6 and the piston 4. The slide shoe 6 is also provided with a through-bore 15, through which the hydraulic fluid can then continue further to the region between the slide shoe 6 and the swash plate 5 in order there to effect cooling and, optionally, also a hydrostatic bearing.

In the case under discussion, the hydraulic fluid used is preferably water, that is, a fluid that has virtually no lubricating properties. The lubricating property is therefore assumed by the layer 11 of friction-reducing plastics material. This layer covers all areas at which friction can occur, at least in the region between the cylinder drum 2 and the piston 4 and in the region between slide shoe 6 and the piston 4.

The term "friction-reducing" is always with respect, of course, to the material pairing used. If the slide shoe 6 and the cylinder drum 2 consist of metal, for example, iron or steel, then a suitable plastics material comprises a material from the group of high-strength thermoplastic plastics materials based on polyarylether ketones, in particular polyether ether ketones, polyamides, polyacetals, polyaryl ethers, polyethylene terephthalates, polyphenylene sulphides, polysulphones, polyether sulphones, polyether imides, polyamideimide, polyacrylates, phenol resins, such as novolak resins, or similar substances; glass, graphite, polytetra- fluoroethylene or carbon, especially in fibre form, can be used as fillers. When using such materials, it is possible to use even water as hydraulic fluid.

The layer 11 completely surrounds the core 13 of the piston 4, that is, this layer lines also the through-bore 14 of the piston 4. In this manner a virtually seam-free sheathing of the piston 4 can be achieved, so that no hydraulic fluid is able to penetrate between the core 13 and the layer 11 which could lead to the layer becoming detached from the core 13.

Assembly of such an arrangement is relatively easy. The spherical socket 8 has an opening of which the diameter is larger than the diameter of the head 7. The spherical head 7 can therefore be inserted in the spherical socket 8. The parts thus assembled are afterwards inserted in an injection mould and the layer 11 is applied by an injection-moulding method during which the friction-reducing plastics material is injected into the injection mould. During this operation, the plastics material fills the region between the spherical head 7 and the spherical socket 8 so that the opening of the spherical socket 8 now provided with the plastics material has a smaller diameter than the diameter of the spherical head 7. The spherical head 7 then sits tightly in the spherical socket 8 and cannot be taken out.

During injection-moulding, not only is the layer 11 between the piston 4 and the cylinder 3 formed, but simultaneously also the layer between the spherical head 7 and the spherical socket 8.

By virtue of this construction, the end of the piston 4 projecting into the cylinder 3 is covered also on its end face 16 with the plastics material 11. The plastics material can here have a damping function, in particular, as shown purely diagrammatically in FIG. 1, when this end of the cylinder 3 is provided with a sliding sleeve 17 by means of which the cylinder 3 is connected to a valve disc, not shown.

Figure 2:
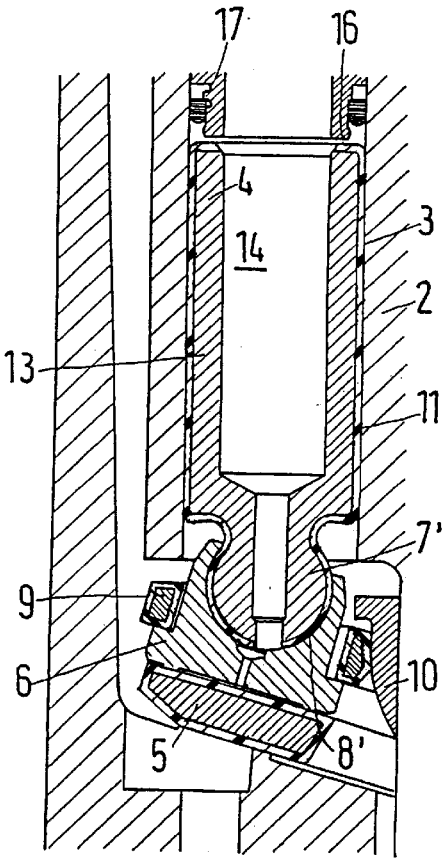
FIG. 2 shows a second construction.

FIG. 2 shows another construction, in which identical parts or parts of identical function are provided with the same reference numerals. Corresponding parts are denoted by primed reference numerals.

Compared with FIG. 1, there are, in principle, two changes. Firstly, the spherical head 7' is no longer secured to the slide shoe 6 but to the piston 4. The spherical socket 8' is accordingly arranged on the slide shoe 6. The layer 11 also has a somewhat different form in this region. It no longer lines the spherical socket 8', but surrounds the spherical head 7'. There is no great difference as regards function, however. By means of the unlined spherical socket 8' the slide shoe 6 slides on the spherical head 7' which is provided with the friction-reducing layer 11.

Furthermore, the core 13 of the piston 4 is no longer completely sheathed. On the contrary, the layer 11 of the friction-reducing plastics material is restricted to the outside of the core. However, in that case the end face 16 is covered too. There are two reasons for that. Firstly, the layer 11 on the end face 16 continues to serve as buffer. Secondly, by this measure one can ensure that the area of the layer 11 on which the pressure in the cylinder 2 acts to press the layer 11 against the core 13 of the piston 4 is always larger than the area over which the pressure acts parallel to the bearing surface of the core 13. The forces that hold the layer 11 fixedly on the core 13 are therefore always greater than the forces which attempt to detach the layer from the core 13.

The layer 11 of the friction-reducing plastics material can be very thin. In FIG. 1 it is shown exaggeratedly thick in some portions. For that reason the construction of the piston 4 with a friction-reducing layer has virtually no effect on the strength and thus on the pressures to which the piston can be exposed in the cylinder 3. The strength and the resistance to pressure continue to be determined by the core 13.

We claim:

1. A hydraulic piston machine having a piston arranged to move back and forth in a cylinder body, the piston having an outer face in the cylinder body and a layer of a friction-reducing plastics material on the outer face sliding on the cylinder body, a slide shoe proximate one end of the piston, an articulated joint located at said one end of the piston, the articulated joint connecting the sliding shoe to the piston, and the articulated joint having a bearing face at said one end, the layer being continued from the outer face over the bearing face.

2. A machine according to claim 1, in which the piston has an end face opposite said one end and projecting into the cylinder body, the layer extending over at least a part of the end face of the piston which projects into the cylinder body.

3. A machine according to claim 1, in which the piston has a through-channel and the layer also lines the through-channel.

4. A machine according to claim 1, in which the layer covers only a part of the outer face of the piston.

5. A machine according to claim 4, in which the layer terminates within a space between the piston and the cylinder body loaded with fluid pressure, an area loaded with fluid pressure always being larger than the area of an outer surface of the layer.

6. A machine according to claim 1, in which the articulated joint comprises a spherical head and a spherical socket, the spherical socket having an opening having a diameter at least as large as the diameter of the spherical head and enclosing the spherical head in cross-section by more than 180°, and the layer has a thickness that increases the diameter of the spherical head so that the diameter of the spherical head is larger than the diameter of the opening of the spherical socket.

7. A method of mounting a piston/slide shoe unit of a hydraulic piston machine according to claim 1, in which the piston and the slide shoe are assembled, the piston being provided with a layer of friction-reducing plastics material and the plastics material being inserted into the articulated joint between the piston and the slide shoe.

8. A method according to claim 7, in which the plastics material is injection-moulded.

9. A method according to claim 7, in which all the plastics material is applied in one operation.

* * * * *